US006971476B2

(12) United States Patent
Wolner et al.

(10) Patent No.: US 6,971,476 B2
(45) Date of Patent: Dec. 6, 2005

(54) SAFETY HARNESS

(75) Inventors: J. Thomas Wolner, Red Wing, MN (US); Scott C. Casebolt, St. Paul Park, MN (US)

(73) Assignee: D B Industries, Inc., Red Wing, MN (US)

( * ) Notice: Subject to any disclaimer, the term of this patent is extended or adjusted under 35 U.S.C. 154(b) by 0 days.

(21) Appl. No.: 10/819,035

(22) Filed: Apr. 6, 2004

(65) Prior Publication Data

US 2005/0067221 A1 Mar. 31, 2005

Related U.S. Application Data

(60) Provisional application No. 60/500,597, filed on Sep. 5, 2003.

(51) Int. Cl.[7] ..... A47L 3/04; A62B 35/00
(52) U.S. Cl. ..... 182/3; 119/770; 182/6
(58) Field of Search ..... 182/3, 4, 5, 6, 182/7; 244/151 R; 119/96, 857, 770

(56) References Cited

U.S. PATENT DOCUMENTS

| | | | | |
|---|---|---|---|---|
| 1,784,162 A * | 12/1930 | Smith | 244/151 R |
| 5,131,490 A * | 7/1992 | Bell | 182/3 |
| 5,329,884 A * | 7/1994 | Bell | 182/3 |
| 5,540,188 A * | 7/1996 | Heinrichs | 119/770 |
| 5,746,013 A | 5/1998 | Fay, Sr. | |
| 5,957,091 A * | 9/1999 | McDonald et al. | 119/770 |
| 6,253,874 B1 | 7/2001 | Casebolt et al. | |
| 6,315,007 B1 * | 11/2001 | Mohamed et al. | 139/11 |
| D454,986 S | 3/2002 | Casebolt et al. | |
| 6,378,465 B1 * | 4/2002 | Austin | 182/4 |
| 6,520,290 B1 | 2/2003 | Carter | |

FOREIGN PATENT DOCUMENTS

| | | |
|---|---|---|
| DE | 299 19 016 U1 | 12/1999 |
| EP | 0 508 278 A1 | 10/1992 |

OTHER PUBLICATIONS

Protecta International, Inc., "Removable Shoulder Pads for Full Body Harness", product brochure, Nov. 2001, 2 pgs.
Protecta International, Inc., "Silverback Standard Full Body Harness AB2001A", product brochure, Sep. 2002, 1 pg.
Mine Safety Appliances Co., "Take the TechnaCurve Challenge", product brochure, Aug. 2003, 4 pgs.
Bacou-Dalloz, "Miller Ultra Harnesses", product brochure, Sep. 2003, 2 pgs.

* cited by examiner

*Primary Examiner*—Hugh B. Thompson, II
(74) *Attorney, Agent, or Firm*—IPLM Group, P.A.

(57) ABSTRACT

A preferred embodiment safety harness includes two straps that are operatively connected at a juncture and a D-ring proximate the juncture. A retrofittable, removable back panel padding is configured and arranged to accommodate the straps and the D-ring to aid in the comfort in donning the safety harness.

30 Claims, 7 Drawing Sheets

SAFETY HARNESS

This application claims the benefit of U.S. Provisional Application No. 60/500,597, filed Sep. 5, 2003.

BACKGROUND OF THE INVENTION

1. Field of the Invention

The present invention relates to a safety harness and components thereof.

2. Description of the Prior Art

Various occupations place people in precarious positions at relatively dangerous heights thereby creating a need for fall-arresting safety apparatus. Among other things, such apparatus usually include a safety line interconnected between a support structure and a person working in proximity to the support structure. The safety line is typically secured to a full-body safety harness worn by the worker. Obviously, such a harness must be designed to remain secure about the worker in the event of a fall. In addition, the harness should arrest a person's fall in as safe a manner as possible, placing a minimal amount of strain on the person's body. Yet another design consideration is to minimize the extent to which people may consider the harness uncomfortable and/or cumbersome.

Fall-arresting harnesses have been made with various features to enhance user comfort and/or more evenly distribute or absorb impact associated with a fall. However, these features must not compromise the effectiveness of the harness. In other words, there is a need for a safety harness that strikes an appropriate balance between user safety and user comfort.

SUMMARY OF THE INVENTION

A preferred embodiment safety harness includes a first strap and a second strap operatively connected at a juncture, a D-ring operatively connected to the straps proximate the juncture, and a removable padding configured and arranged to operatively connect to the straps proximate the juncture. The padding accommodates the D-ring without interfering with operation of the D-ring. The straps and the D-ring are movable and adjustable independently of the padding, and the padding is retrofittable.

A preferred embodiment safety harness includes a first strap and a second strap operatively connected at a juncture and a removable padding configured and arranged to operatively connect to the first strap and the second strap proximate the juncture. The first strap and the second strap cooperate to form four strap segments extending from the juncture. The padding includes four pad segments proximate each of the four strap segments. The four pad segments extend outward from a back pad proximate the juncture. The four pad segments each including a channel in which each respective strap segment is slidably secured to the padding. The padding is retrofittable.

A preferred embodiment retrofittable, removable padding for use with a safety harness donned by a worker includes a padding and a panel. The safety harness includes a first strap and a second strap operatively connected at a juncture and a D-ring operatively connected to the straps proximate the juncture. The padding is configured and arranged to operatively connect to the straps of the safety harness proximate the juncture. The padding accommodates the D-ring without interfering with operation of the D-ring, and the straps and the D-ring are movable and adjustable independently of the padding. The padding is positioned between the worker and the straps of the safety harness. The panel is operatively connected to the padding proximate each of the straps, and the panel forms a channel proximate each of the straps in which each of the straps is slidably secured between the panel and the padding. The panel has an open position and a closed position. The open position provides access to the channel, and the closed position releasably secures each of the straps within each channel between the panel and the padding. Each of the straps is removable from the padding when each respective panel is in the open position.

A preferred embodiment method of retrofitting a removable padding onto a safety harness donned by a worker includes providing a safety harness and providing a removable padding. The safety harness includes a first strap and a second strap operatively connected at a juncture and a D-ring operatively connected to the straps proximate the juncture. The removable padding is configured and arranged to operatively connect to the straps of the safety harness proximate the juncture. The padding is connected to the straps of the safety harness. The padding accommodates the D-ring without interfering with operation of the D-ring. The straps and the D-ring are movable and adjustable independently of the padding. The padding is connected to the straps of the safety harness by placing the straps of the safety harness within channels of the padding and securing the straps of the safety harness within the channels of the padding. The padding has an open position and a closed position. The open position provides access to the channels. The closed position releasably secures the straps within the channels of the padding. The open position allows the straps to be removed from the padding.

DETAILED DESCRIPTION OF A PREFERRED EMBODIMENT

Figure 2:
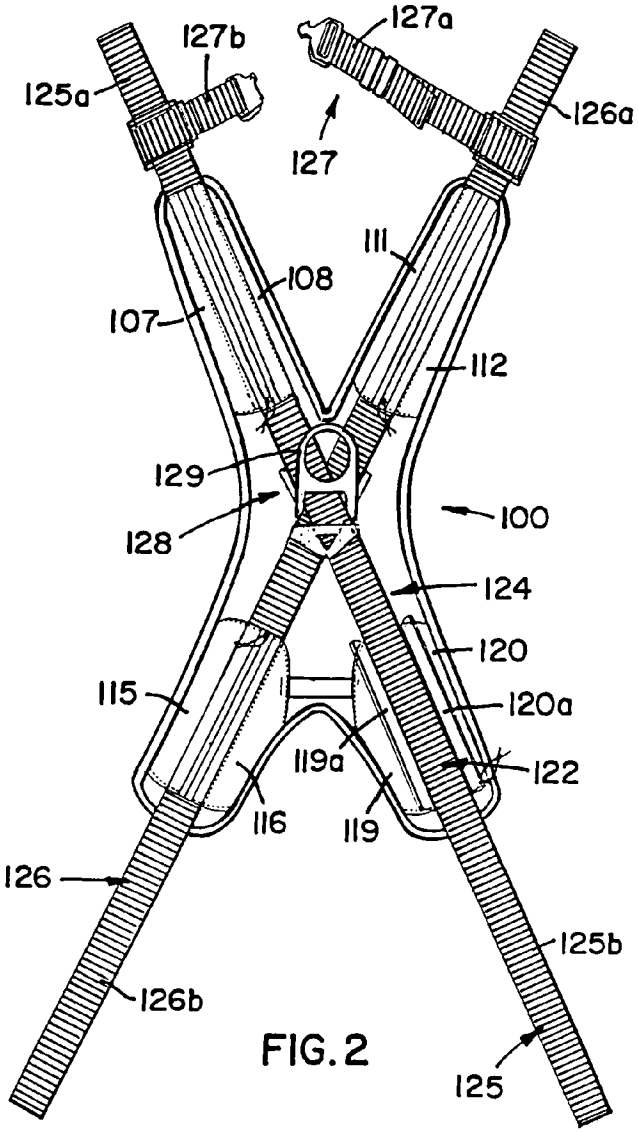
FIG. 2 is a front view of the removable back panel padding shown in FIG. 1 with a safety harness.

Preferred embodiment safety harnesses and components thereof constructed according to the principles of the present invention are shown in the drawings, wherein like numerals represent like components throughout the drawings.

Figure 1:
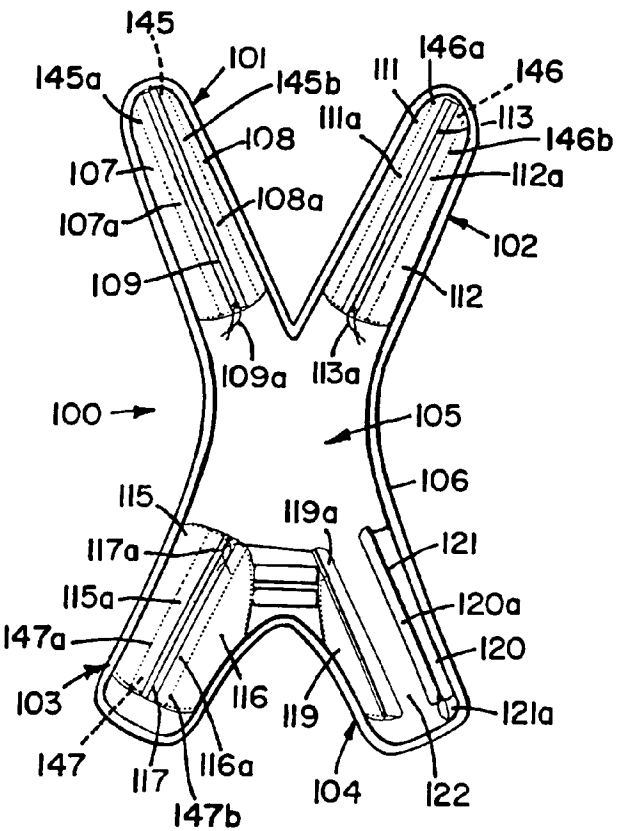
FIG. 1 is a front view of a removable back panel padding for use with a safety harness constructed according to the principles of the present invention.

A preferred embodiment retrofittable and removable back panel padding 100 for use with a safety harness 124 is shown in FIGS. 1–4. With reference to FIGS. 1 and 2, the removable back panel padding 100 includes a left shoulder pad 101, a right shoulder pad 102, a left waist pad 103, a right waist pad 104, and a back pad 105. The back pad 105 interconnects the pads 101, 102, 103, and 104 to form the padding 100. A binding 106 is sewn around the perimeter of the padding 100. Although any suitable material well known in the art may be used, the binding 106 is preferably one piece soft polyester grosgrain that is folded over from the front side to the back side of the padding 100 and is sewn through the padding 100 proximate each edge of the binding 106 to fasten each side of the binding 106 to the padding 100. The binding 106 finishes the edges of the padding 100 and connects the layers of material used in the padding 100.

The left shoulder pad 101 includes a fabric panel 107 on the left side and a fabric panel 108 on the right side. Each panel 107 and 108 is secured by the binding 106 along one side and along the top end. The opposite sides of the panels 107 and 108, which are each proximate the middle of the pad 101, are folded over and sewn at stitching 145*a* and 145*b* to create flaps 107*a* and 108*a*, respectively. Stitching 145*a* and 145*b* are shown as dashed lines. The flaps 107*a* and 108*a* provide two edges along which each side of a zipper 109 may be sewn. In other words, the panels 107 and 108 are releasably interconnected proximate the middle of the pad 101 by the zipper 109. A channel 145 in which a left shoulder strap may be slidably and releasably secured is created under the zipper 109 and flaps 107*a* and 108*a* and above the pad 101. In other words, the stitching 145*a* and 145*b* define the approximate width of the channel 145. A zipper pull 109*a* is used to fasten and to open the zipper 109 when the left shoulder strap is to be secured within and removed from the channel in the pad 101.

The right shoulder pad 102 includes a fabric panel 111 on the left side and a fabric panel 112 on the right side. Each panel 111 and 112 is secured by the binding 106 along one side and along the top end. The opposite sides of the panels 111 and 112, which are each proximate the middle of the pad 102, are folded over and sewn at stitching 146*a* and 146*b* to create flaps 111*a* and 112*a*, respectively. Stitching 146*a* and 146*b* are shown as dashed lines. The flaps 111*a* and 112*a* provide two edges along which each side of a zipper 113 may be sewn. In other words, the panels 111 and 112 are releasably interconnected proximate the middle of the pad 102 by the zipper 113. A channel 146 in which a right shoulder strap may be slidably and releasably secured is created under the zipper 113 and flaps 111*a* and 112*a* and above the pad 102. In other words, the stitching 146*a* and 146*b* define the approximate width of the channel 146. A zipper pull 113*a* is used to fasten and to open the zipper 113 when the right shoulder strap is to be secured within and removed from the channel in the pad 102.

The left waist pad 103 includes a fabric panel 115 on the left side and a fabric panel 116 on the right side. Each panel 115 and 116 is secured by the binding 106 along one side and along the bottom end. The opposite sides of the panels 115 and 116, which are each proximate the middle of the pad 103, are folded over and sewn at stitching 147*a* and 147*b* to create flaps 115*a* and 116*a*, respectively. Stitching 147*a* and 147*b* are shown as dashed lines. The flaps 115*a* and 116*a* provide two edges along which each side of a zipper 117 may be sewn. In other words, the panels 115 and 116 are releasably interconnected proximate the middle of the pad 103 by the zipper 117. A channel 147 in which a left leg strap may be slidably and releasably secured is created under the zipper 117 and 115*a* and 116*a* and above the pad 103. In other words, the stitching 147*a* and 147*b* define the approximate width of the channel 147. A zipper pull 117*a* is used to fasten and to open the zipper 117 when the left leg strap is to be secured within and removed from the channel in the pad 103.

The right waist pad 104 includes a fabric panel 119 on the left side and a fabric panel 120 on the right side. Each panel 119 and 120 is secured by the binding 106 along one side and along the bottom end. The opposite sides of the panels 119 and 120, which are each proximate the middle of the pad 104, are folded over and sewn to create flaps 119*a* and 120*a*, respectively. The flaps 119*a* and 120*a* provide two edges along which each side of a zipper 121 may be sewn. In other words, the panels 119 and 120 are releasably interconnected proximate the middle of the pad 104 by the zipper 121. A channel 122 in which a right leg strap may be slidably and releasably secured is created under the zipper 121 flaps 119*a* and 120*a* and above the pad 104. Flaps 119*a* and 120*a* are opened to expose channel 122, which is shown in an opened position. Channel 122 is similar to channels 145, 146, and 147, which are shown in a closed position because the corresponding flaps are releasably interconnected and thereby closed. A zipper pull 121*a* is used to fasten and to open the zipper 121 when the right leg strap is to be secured within and removed from the channel in the pad 104.

As stated previously, the back pad 105 interconnects the pads 101, 102, 103, and 104 to form the padding 100, which is configured and arranged to engage a safety harness 124. The safety harness 124 includes a first strap 125 and a second strap 126, which overlap at a juncture and criss-cross in divergent fashion proximate the back of the safety harness 124, as shown in FIG. 2. The first strap 125 includes a left shoulder strap 125*a* and a right leg strap 125*b*, which are operatively connected proximate the juncture. The second strap 126 includes a right shoulder strap 126*a* and a left leg strap 126*b*, which are operatively connected proximate the juncture. In other words, four strap segments extend from proximate the juncture. The safety harness 124 also includes a chest strap 127, which includes a first strap 127*a* and a second strap 127*b*. The back pad 105 also accommodates a back pad assembly 128 of the safety harness 124 proximate the juncture. The back pad assembly 128 includes a D-ring 129, which is operatively connected to the straps proximate the juncture.

Figure 4:
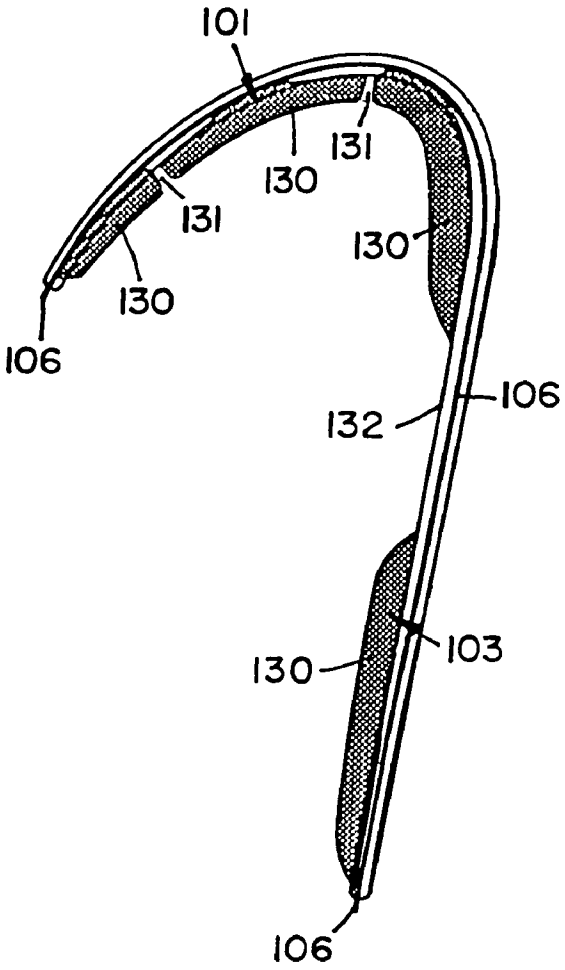
FIG. 4 is a side view of the removable back panel padding shown in FIG. 1.
Figure 3:
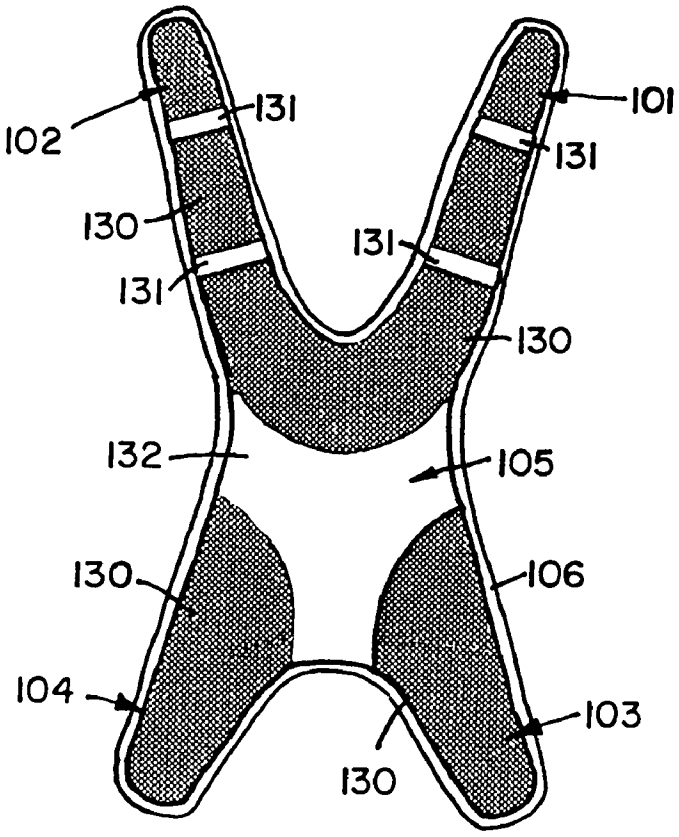
FIG. 3 is a back view of the removable back panel padding shown in FIG. 1.

With reference to FIGS. 3 and 4, the back side of the padding 100 preferably includes foam pads 130, air channels 131, and 3D fabric 132. The 3D fabric 132, which is very breathable, is used as a base panel for the padding 100, and the foam pads 130 are cut and positioned on the 3D fabric 132. The 3D fabric 132 is discussed in more detail below. An example of a 3D fabric that may be used is DRI-LEX™ AERO-SPACER™ lining, which is covered by U.S. Pat. No. 5,746,013 incorporated by reference herein, by Faytex Corp.

of Weymouth, Mass. Other suitable types of 3D fabric well known in the art may also be used. The foam pads 130 are preferably ¾ inch thick EVA foam. On pads 101 and 102, there are preferably foam pads 130 proximate each end, proximate a middle section of each pad 101 and 102, and spanning from pad 101 to 102 along the binding 106 and into a top portion of pad 105. Air channels 131 separate the foam pads 130 between these sections and are preferably ¼ inch wide. As shown in FIG. 4, there is an air channel 131 at the top of each shoulder and near each collarbone of the user. There are preferably foam pads 130 on the pads 103 and 104 and extending partially into the pad 105. 3D fabric is used in the remaining portion of the back pad 105 and between the pads 103 and 104. The air channels 131 and the 3D fabric allow air to flow through the padding 100 so that the padding 100 does not get as warm for the user.

Figure 7:
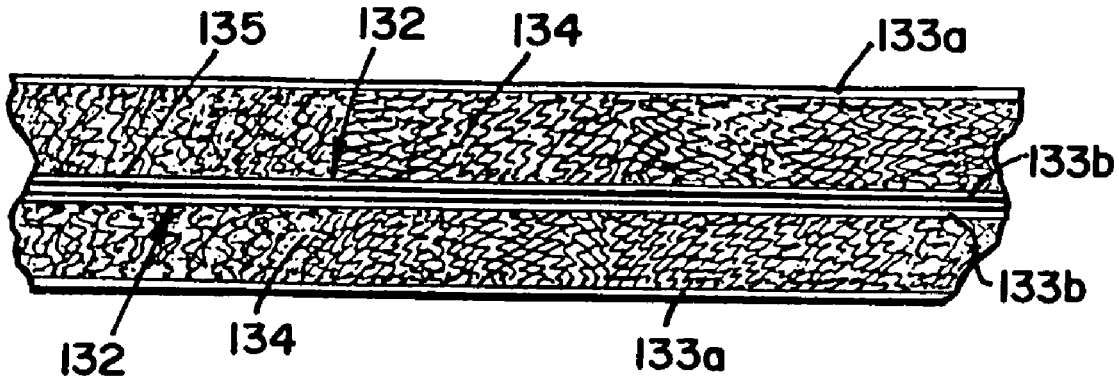
FIG. 7 is a cross-sectional view of a fabric of the removable back panel padding shown in FIGS. 1 and 5.

A cross-section of a portion of a preferred construction of pad 105 is shown in FIG. 7. Pad 105 preferably includes two layers of 3D fabric 132 with a foam stiffener 135 in between the two layers of 3D fabric 132. The 3D fabric 132 preferably includes a first outer layer 133*a*, a middle layer 134, and a second outer layer 133*b*. The first outer layer 133*a* is preferably made of a hydrophobic material such as a polyester mesh material. The second outer layer 133*b* is preferably made of a hydrophilic material such as nylon. The middle layer 134 interconnects the outer layers 133*a* and 133*b* and is an air chamber preferably made of monofilament yarns interknitted with both inner and outer knit layers in a known manner such as with the use of the well-known Raschel tricot knitting machine. The monofilament yarns are preferably a hydrophobic material such as a polyester material. The middle layer 134 allows air to flow through the fabric thereby making the fabric more comfortable to don. In the preferred embodiment, the second outer layers 133*b* are placed proximate the foam stiffener 135 and the first outer layers 133*a* are placed proximate the outer surfaces of the pad 105. This arrangement allows moisture to be wicked away from the outer surface of the fabric and drawn toward the center of the fabric also aiding in the comfort of the fabric. The 3D fabric 132 allows moisture to be drawn away from the worker donning the padding 100 and allows air to circulate through the fabric thereby assisting in cooling the worker. The foam stiffener 135 is optional and is preferably used in the pad 105 to provide some support for the back pad assembly 128. A stiffener may also be used in the shoulder area to provide some structure.

In operation, the zippers 109, 113, 117, and 121 are opened to expose the channels, which are preferably approximately 2 inches wide to accommodate the straps 125 and 126 of the safety harness 124. The safety harness 124 is placed on top of the padding 100 so that the juncture and the back pad assembly 128 are placed proximate the center of the back pad 105. The left shoulder strap 125*a* is placed within the channel on pad 101, and zipper 109 is fastened over the top of the left shoulder strap 125*a*. The right shoulder strap 126*a* is placed within the channel on pad 102, and zipper 113 is fastened over the top of the right shoulder strap 126*a*. The left leg strap 126*b* is placed within the channel on pad 103, and zipper 117 is fastened over the top of the left leg strap 126*b*. The right leg strap 125*b* is placed within the channel 122 on pad 104, as shown in FIG. 2, and zipper 121 is fastened over the top of the right leg strap 125*b*. Securing the straps 125 and 126 within the channels may be performed in any order. The padding 100 has four pad segments corresponding with the four strap segments, and the padding 100 accommodates the back pad assembly 128 and the D-ring 129 without interfering with operation of the D-ring 129. The straps 125 and 126 and the D-ring 129 are movable and adjustable within the channels of the padding 100, independently of the padding 100. In other words, the straps 125 and 126 are slidably secured within the channels by the padding 100. The back pad assembly 128 may be adjusted along the straps 125 and 126 to the proper position for the user with or without removing the safety harness 124 from the padding 100.

Figure 6:
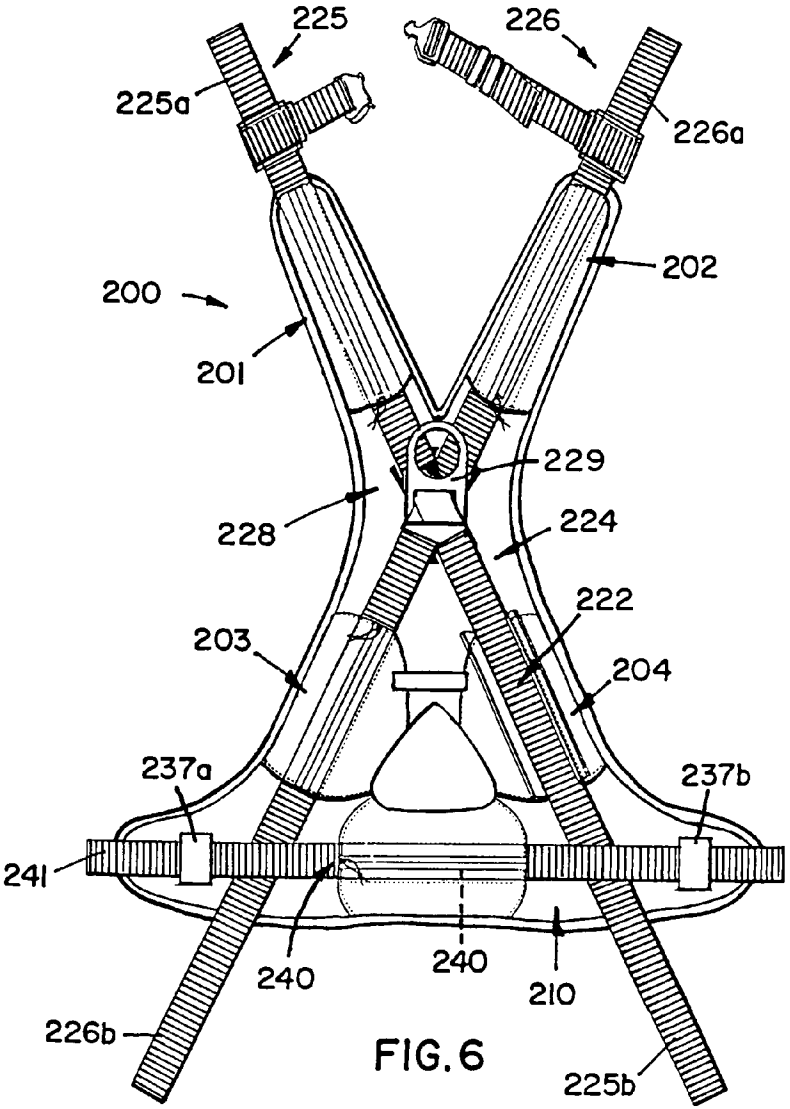
FIG. 6 is a front view of the removable back panel padding shown in FIG. 5 with a safety harness including a hip belt.
Figure 5:
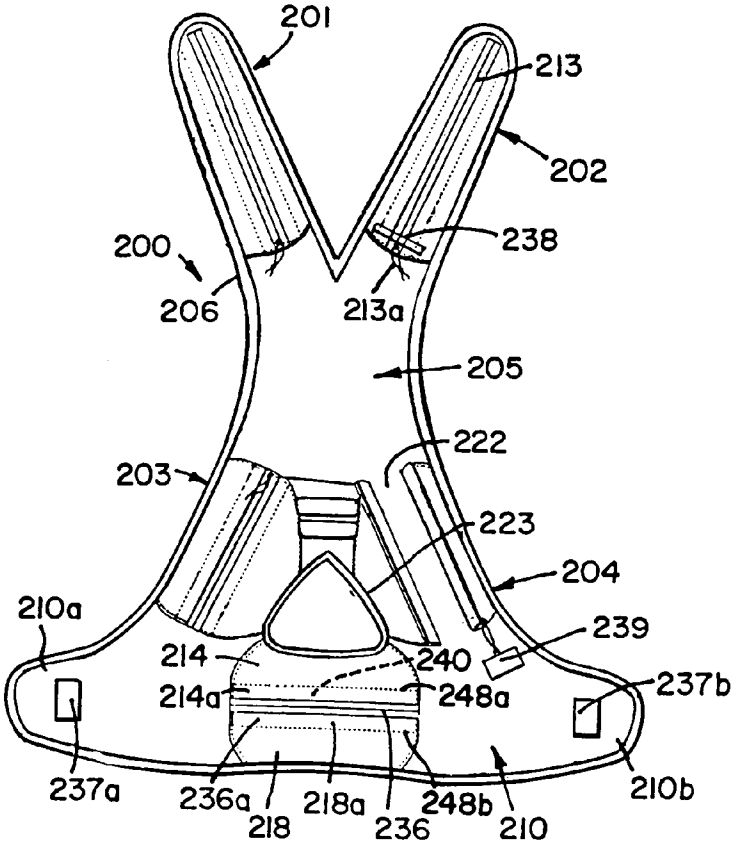
FIG. 5 is a front view of another embodiment removable back panel padding for use with a safety harness including a hip belt constructed according to the principles of the present invention.

FIGS. 5 and 6 show another preferred embodiment removable back panel padding 200. Like the padding 100, the padding 200 includes a left shoulder pad 201, a right shoulder pad 202, a left waist pad 203, a right waist pad 204, and a back pad 205. The back pad 205 interconnects the pads 201, 202, 203, and 204. In addition, the padding 200 includes a hip pad 210 extending along the bottom of the padding 200 and including a left end 210*a* and a right end 210*b*. The hip pad 210 interconnects pads 203 and 204 and creates an opening 223 therebetween.

A binding 206 is sewn around the perimeter of the padding 200 and within the opening 223. The binding 206 is one piece that is folded over from the front side to the back side of the padding 200 and is sewn through the padding 200 proximate each edge of the binding 206 to fasten each side of the binding 206 to the padding 200. The binding 206 finishes the edges of the padding 200 and connects the layers of fabric used in the padding 200.

As with padding 100, the pads 201, 202, 203, and 204 of padding 200 each include fabric panels, flaps, and zippers to form channels in which straps of a safety harness may be secured. The hip pad 210 also includes a fabric panel 214 proximate the top of the pad 210 and below the opening 223 and a fabric panel 218 proximate the bottom of the pad 210. The panel 214 is secured by the binding 206 along the top side and the panel 218 is secured by the binding 206 along the bottom side. The opposite sides of the panels 214 and 218, which are each proximate the middle of the pad 210, are folded over and sewn at stitching 248*a* and 248*b* to create flaps 214*a* and 218*a*, respectively. Stitching 248*a* and 248*b* are shown as dashed lines. The flaps 214*a* and 218*a* provide two edges along which each side of a zipper 236 may be sewn. In other words, the panels 214 and 218 are releasably interconnected proximate the middle of the pad 210 by the zipper 236. A channel 240 in which a hip strap 241 may be slidably and releasably secured is created under the zipper 236 and flaps 214*a* and 218*a* and above the pad 210. In other words, the stitching 248*a* and 248*b* define the approximate width of the channel 240. A zipper pull 236*a* is used to fasten and to open the zipper 236 when the hip strap 241 is to be secured within and removed from the channel 240 in the pad 210.

Optionally, the padding 200 may also include keepers 237*a* and 237*b*. Keepers 237*a* and 237*b* are preferably made of VELCRO® hook and loop fasteners sewn or otherwise fastened proximate the left end 210*a* and the right end 210*b*, respectively, of the pad 210. The keepers 237*a* and 237*b* secure portions of the hip strap 241 proximate the ends 210*a* and 210*b* of the pad 210. Keepers 237*a* and 237*b* may also be used with padding 100.

Preferably, the zippers include locking zipper pulls. Another option is to include a zipper stop 238, shown in FIG. 5. The zipper stop 238 is preferably made of a VELCRO® loop sewn or otherwise fastened to the pad 202 proximate the zipper pull 213*a* when the zipper 213 is closed. The zipper stop 238 helps keep the zipper pull 213*a* from sliding along the zipper 213 thereby opening and unfastening the zipper 213 and releasing the harness strap. Although only one zipper stop 238 is shown proximate the zipper pull 213*a* on pad 202, it is recognized that a zipper stop 238 may be placed proximate any of the zipper pulls. In addition, a zipper stop 238 may be used with both the paddings 100 and 200. Alternatively, rather than using zippers with any of the embodiments, VELCRO®, laces, buckles, snaps, or other suitable fasteners well known in the art could be used to secure the padding about the harness straps.

Another option is to include a holder 239, shown in FIG. 5, to which the end of a device such as a lanyard may be releasably connected when not in use. For example, with a lanyard, one end is connected to a D-ring on the back pad of a harness and the other end that would normally be connected to a lifeline could be connected to the holder 239. This would keep the loose end from catching on an object or even tripping the user when not connected to a lifeline. The holder 239 is preferably made of a VELCRO® loop sewn or otherwise fastened to the padding 200 in a location in which it will be relatively easy to use. The holder 239 is shown proximate the right hip region of the user but may be placed in any location on the padding 200. The holder 239 may also be used with padding 100.

As shown in FIG. 6, the padding 200 is configured and arranged to engage a safety harness 224 including straps 225 and 226 and a hip belt 241. The safety harness 224 includes a first strap 225 and a second strap 226, which overlap at a juncture and criss-cross in divergent fashion proximate the back of the safety harness 224, as shown in FIG. 6. The first strap 225 includes a left shoulder strap 225*a* and a right leg strap 225*b*, which are operatively connected proximate the juncture. The second strap 226 includes a right shoulder strap 226*a* and a left leg strap 226*b*, which are operatively connected proximate the juncture. In other words, four strap segments extend from proximate the juncture. Right leg strap 225*b* is shown within channel 222 in FIG. 6. The safety harness 224 also includes a hip strap 241, which extends across the back of the user proximate the hip area. A back pad assembly 228 having a D-ring 229 is also included in the safety harness 224. The D-ring 229 is operatively connected to the straps 225 and 225 proximate the juncture.

In operation, the zippers are opened to expose the channels. The safety harness 224 is placed on top of the padding 200 so that the back pad assembly 228 is placed proximate the center of the back pad 205. The left shoulder strap 225*a* is placed within the channel on pad 201, and the zipper is fastened over the top of the left shoulder strap 225*a*. The right shoulder strap 226*a* is placed within the channel on pad 202, and the zipper 213 is fastened over the top of the right shoulder strap 226*a*. The left leg strap 226*b* is placed within the channel on pad 203, and the zipper is fastened over the top of the left leg strap 226*b*. The right leg strap 225*b* is placed within the channel 222 on pad 204, as shown in FIG. 6, and the zipper is fastened over the top of the right leg strap 225*b*. The hip strap 241 is then placed within channel 240 on pad 210, and the zipper 236 is fastened over the top of the hip strap 241. Securing the straps 225, 226, and 241 within the channels may be performed in any order. The padding 200 has four pad segments corresponding with the four strap segments and a fifth pad segment corresponding with the hip strap 241. The padding 200 accommodates the back pad assembly 228 and the D-ring 229 without interfering with operation of the D-ring 229. The straps 225, 226, and 241 and the D-ring 229 are movable and adjustable within the channels of the padding 200, independently of the padding 200. In other words, the straps 225, 226, and 241 are slidably secured within the channels by the padding 200. The back pad assembly 228 may be adjusted along the straps 225 and 226 to the proper position for the user with or without removing the safety harness 224 from the padding 200.

Prior art padding on the back of a safety harness, such as the EXOFIT™ harness model number 1107975 by DBI/SALA, is fixedly attached to the harness. The straps and the back pad and/or D-ring assembly are fixedly attached to the padding and are not adjustable or movable independently from the padding. Because the pack pad and/or D-ring assembly should be in a certain position on the user's back, this type of harness may not easily accommodate different users. In addition, when the D-ring is fixed, the D-ring may not readily slide upward during a fall thereby resulting in the user tilting forward rather than being in an upright position from a fall.

Figure 8:
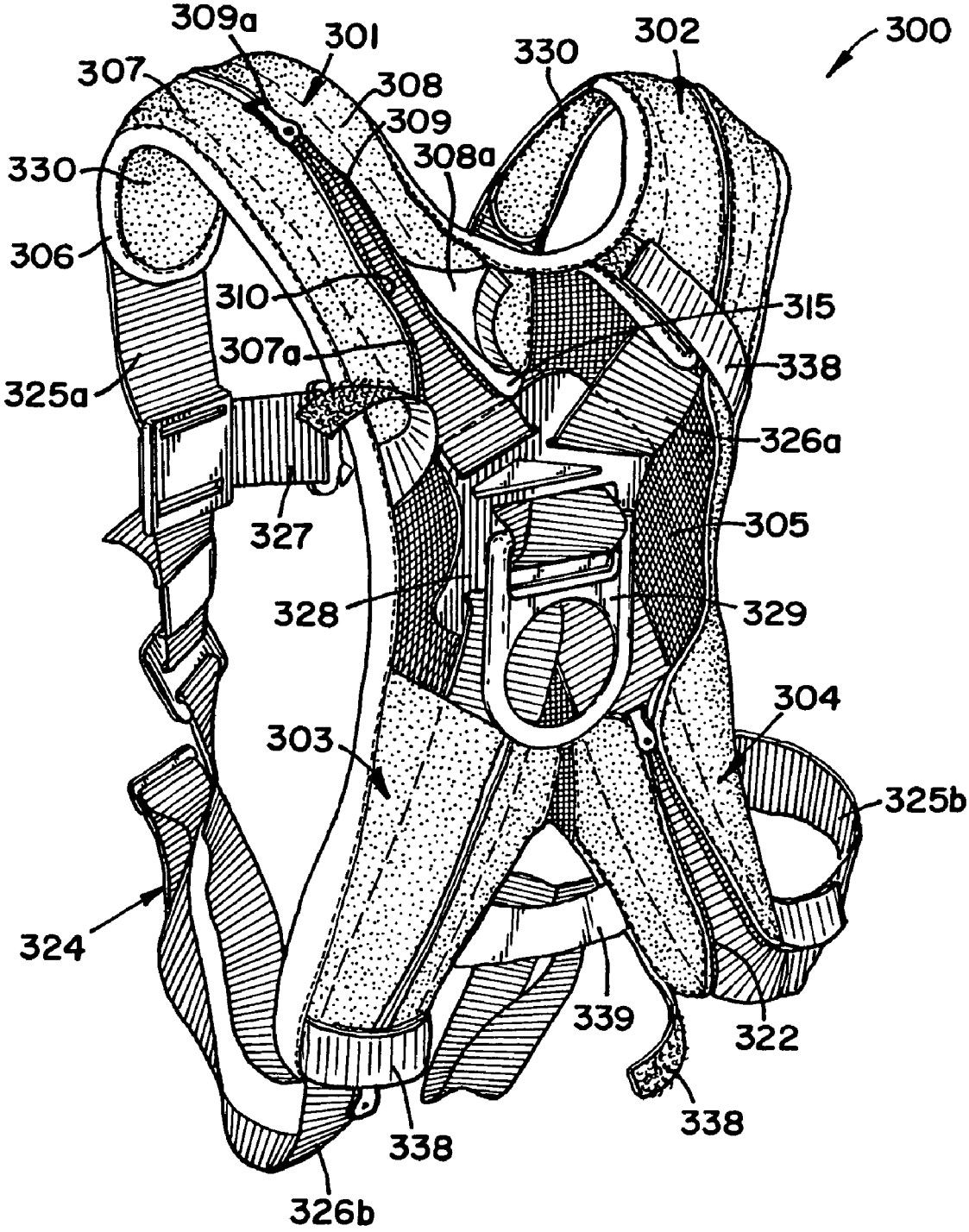
FIG. 8 is a perspective view of a safety harness including a removable back panel padding constructed according to the principles of the present invention.

FIG. 8 shows another embodiment removable back panel padding 300 engaging a safety harness 324 as a safety harness would be donned by a worker. The safety harness 324 includes a left shoulder strap 325*a*, a right shoulder strap 326*a*, a left leg strap 326*b*, a right leg strap 325*b*, and a chest strap 327. The padding 300 is configured and arranged similar to the padding 100 and the safety harness 324 is configured and arranged similar to the safety harness 124, which are discussed in greater detail above.

The removable back panel padding 300 includes a left shoulder pad 301, a right shoulder pad 302, a left waist pad 303, a right waist pad 304, and a back pad 305. The back pad 305 interconnects the pads 301, 302, 303, and 304 to form the padding 300. The back pad 305 is configured and arranged to accommodate a back pad assembly 328 and a D-ring 329 of the safety harness 324. The back of the padding 300 includes foam pads 330 to aid in the comfort in donning the safety harness 324.

A binding 306 is sewn around the perimeter of the padding 300. Although any suitable material well known in the art may be used, the binding 306 is preferably one piece soft polyester grosgrain that is folded over from the front side to the back side of the padding 300 and is sewn through the padding 300 proximate each edge of the binding 306 to fasten each side of the binding 306 to the padding 300. The binding 306 finishes the edges of the padding 300 and connects the layers of material used in the padding 300. Optionally, a strap 339 may be used to interconnect the pads 303 and 304 to assist in keeping the leg straps 325*b* and 326*b* from spreading too far apart. Preferably, the strap 339 is made of an elastic material to aid in the comfort in donning the harness.

The left shoulder pad 301 includes a fabric panel 307 on the left side and a fabric panel 308 on the right side. Each panel 307 and 308 is secured by the binding 306 along one side and along the top end. The opposite sides of the panels 307 and 308, which are each proximate the middle of the pad 301, are folded over and sewn to create flaps 307*a* and 308*a*, respectively. The flaps 307*a* and 308*a* provide two edges along which each side of a zipper 309 may be sewn. In other words, the panels 307 and 308 are interconnected proximate the middle of the pad 301 by the zipper 309. A channel 310 in which the left shoulder strap 325*a* of the safety harness 324 may be secured is created under the zipper 309 and flaps 307*a* and 308*a* and above the pad 301. Within at least a portion of the channel 310 is an optional material 315, which is preferably a rubber-like material, operatively connected to the padding 300. The material 315 provides a frictional surface against which the left shoulder strap 325*a* contacts or rubs to assist in keeping the left shoulder pad 301 in place along the left shoulder strap 325*a*. Preferably, such rubber-like material is placed within each channel proximate the padding to keep the straps of the safety harness in place on the padding. A zipper pull 309*a* is used to fasten and to open the zipper 309 when the left shoulder strap is to be secured within and removed from the channel 310 in the pad 301. The pads 302, 303, and 304 are similarly configured and arranged. A channel 322 is shown in pad 304 in which right leg strap 325*b* is placed.

Optional zipper stops 338 may be secured to each of the pads 301, 302, 303, and 304 proximate each of the zipper pulls when the zippers are closed. The zipper stops 338 are preferably made of a VELCRO® loop sewn or otherwise fastened to the pads. The zipper stops 338 help keep the zipper pulls from sliding along the zippers thereby opening the zippers and releasing the harness straps. This is shown on pads 302 and 303 in FIG. 8. Alternatively, rather than using zippers, VELCRO®, laces, buckles, snaps, or other suitable fasteners well known in the art could be used to secure the padding about the harness straps.

The removable back panel padding 100, 200, and 300 may be configured and arranged to retrofit existing safety harnesses with padding to increase the comfort in wearing the existing safety harnesses, and the removable back panel padding 100, 200, and 300 may be removed for laundering after use. The padding 100, 200, and 300 is positioned between the worker and the straps of the safety harness. The straps of the harness are engaged within the channels of the padding and may slide within the channels, and the back pad and/or D-ring assembly is not so engaged by the padding. In other words, the padding may slide along the lengths of the straps. Because the removable back panel padding 100, 200, and 300 are not fixedly attached to the safety harness, the back pad and/or D-ring assembly may be readily adjusted to the proper position for each user. The back pad and/or D-ring assembly is adjustable and movable independently from the padding. The back pad and/or D-ring may be moved along the lengths of the straps as is well known in the art, and the padding may be adjusted accordingly along the lengths of the straps by sliding the straps through the channels, with the back pad and/or D-ring assembly proximate the back pad 105, 205, and 305. In other words, the straps may be pulled through the channels to obtain excess material proximate the back pad 105, 205, and 305 above or below the back pad and/or D-ring assembly, depending upon the direction the back pad and/or D-ring is to be moved. Then, the back pad and/or D-ring may be adjusted as is well known in the art in the desired direction, and the excess material opposite the direction of movement of the back pad and/or D-ring may be pulled through the channels to take up the slack in the straps. Preferably, there is no slack in the straps proximate the back pad and/or D-ring assembly and the back pad 105, 205, and 305 when worn by the user. Alternatively, the harness may be removed from the padding, the back pad and/or D-ring assembly may be adjusted, and the padding may be connected to the harness again. In addition, because the D-ring is not fixedly attached to the padding, the D-ring may readily slide upward during a fall thereby resulting in the user being in an upright position from a fall, which also adds to the comfort in donning the harness. Further, shoulder strap padding or leg strap padding similarly constructed for easy attachment and removal could be used with an existing safety harness.

Figure 11:
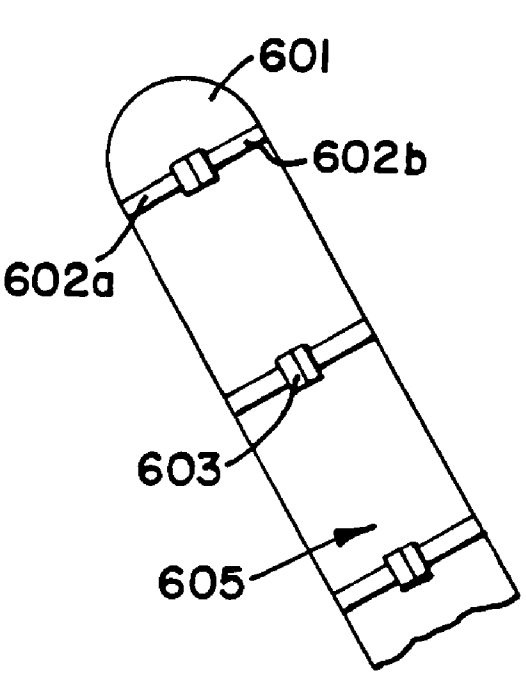
FIG. 11 is a front view of a partial pad of another embodiment removable back panel padding for use with a safety harness constructed according to the principles of the present invention.
Figure 9:
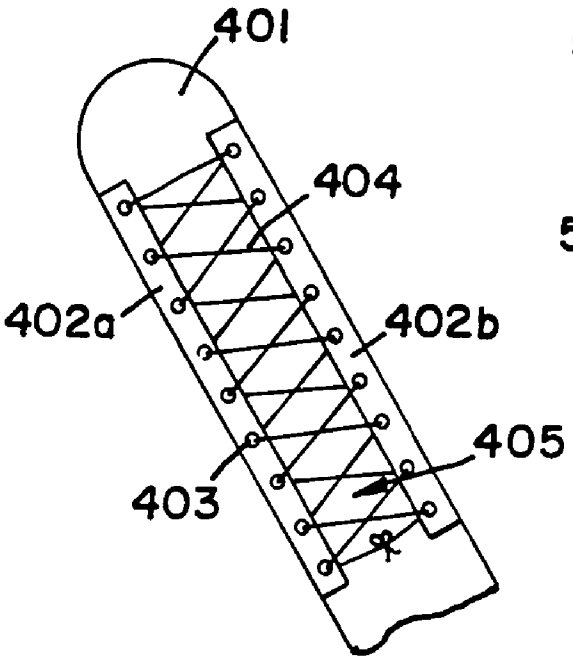
FIG. 9 is a front view of a partial pad of another embodiment removable back panel padding for use with a safety harness constructed according to the principles of the present invention.

In addition, rather than using zippers in any of the embodiments, VELCRO®, laces, buckles, snaps, or other suitable fasteners well known in the art could be used to secure the padding about the harness straps. FIG. 9 shows a pad 401 having a first panel 402*a* on one side of the pad 401 and a second panel 402*b* on the other side of the pad 401. Each panel 402*a* and 402*b* includes grommets 403 through which laces 404 are threaded. A channel 405 is formed between the laces 404 and the pad 401, and the safety harness may be secured within the channel 405. FIG. 11 shows a pad 601 having a first strap 602*a* on one side of the pad 601 and a second strap 602*b* on the other side of the pad 601. A snap or a buckle 603 interconnects the straps 602*a* and 602*b*. A channel 605 is formed between the straps 602*a* and 602*b* and the pad 601, and the safety harness may be secured within the channel 605.

Figure 10:
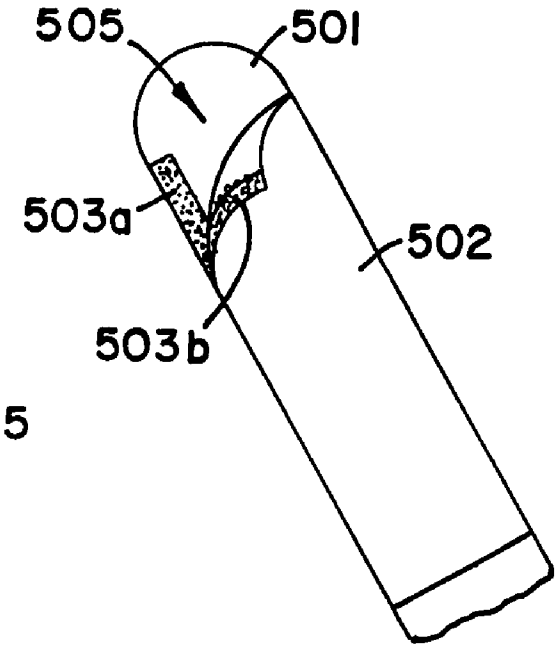
FIG. 10 is a front view of a partial pad of another embodiment removable back panel padding for use with a safety harness constructed according to the principles of the present invention.

Further, rather than having two panels and two flaps, a single panel and a single flap may be used for securing each safety harness strap. The panel could be securable and releasable proximate one side of the pad with a channel underneath the panel. FIG. 10 shows a pad 501 having a panel 502 fixedly attached to one side of the pad 501. The other side of the pad 501 has a piece of VELCRO® 503*a* configured and arranged to mate with a mating piece of VELCRO® 503*b* on the panel 502. A channel 505 is formed between the panel 502 and the pad 501, and the safety harness may be secured within the channel 505. Also, a strap with a snap or a buckle, VELCRO®, a zipper, or snaps could be used to secure each of the straps of the safety harness to the padding. It is recognized that these embodiments are not exhaustive and that other embodiments are within the scope of the present invention.

Figure 12:
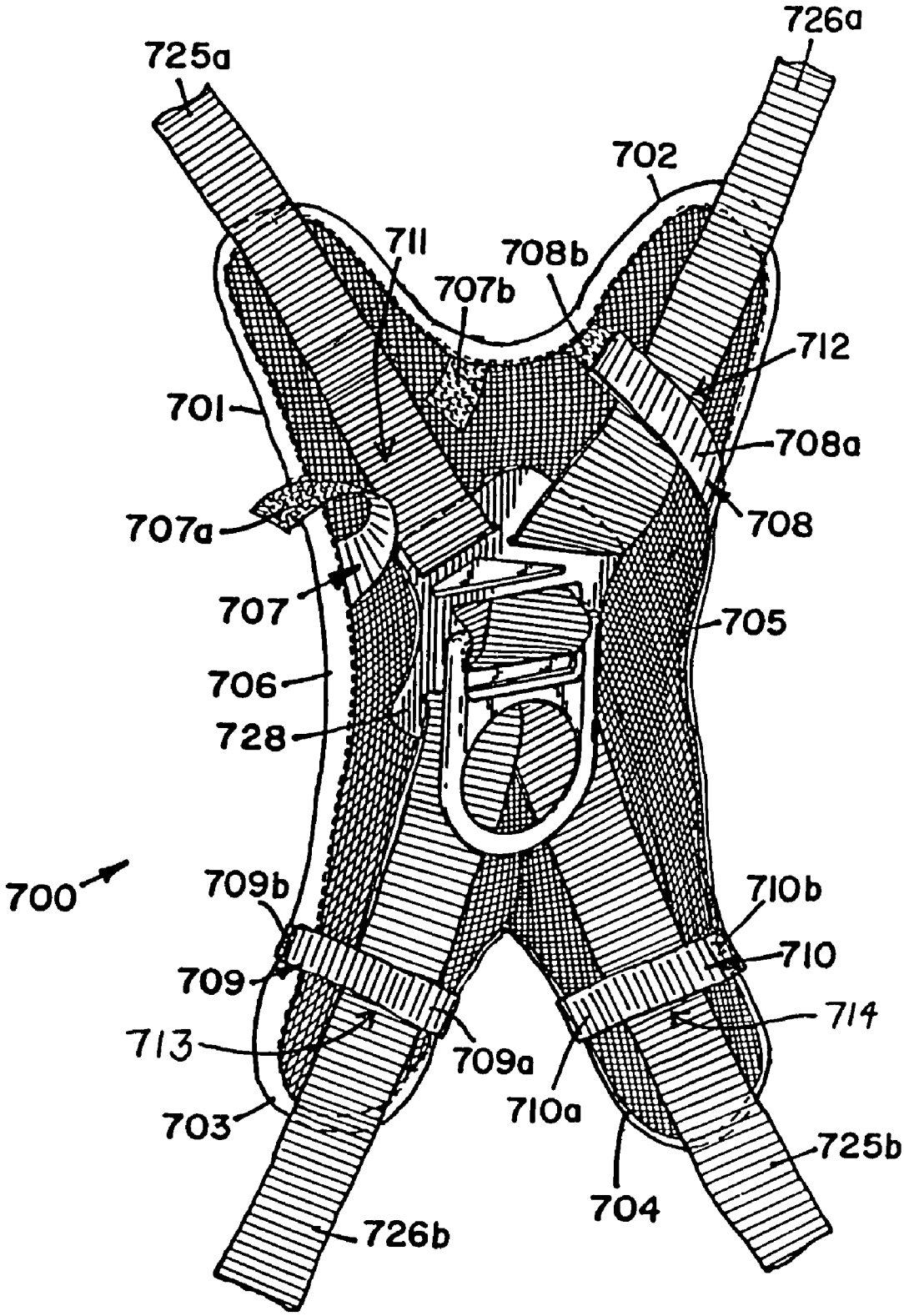
FIG. 12 is a perspective view of another safety harness including another embodiment removable back panel padding constructed according to the principles of the present invention.

Although it is preferred that the removable back panel padding include padding extending over the shoulders of the person donning the harness, this extended padding is not necessary for the present invention. As shown in FIG. 12, a removable back panel padding 700 may span an area proximate a back pad and D-ring assembly 728, which is sufficient to secure the straps 725*a*, 725*b*, 726*a*, and 726*b* of a safety harness to the padding 700 without interfering with the operation of the back pad and D-ring assembly 728. The padding 700 includes a left shoulder pad 701, a right shoulder pad 702, a left waist pad 703, a right waist pad 704, and a back pad 705. The back pad 705 interconnects the pads 701, 702, 703, and 704 to form the padding 700. The back pad 705 is configured and arranged to accommodate the back pad and D-ring assembly 728 of the safety harness. A binding 706 is sewn around the perimeter of the padding 700.

The left shoulder pad 701 includes a strap engaging member 707, which is preferably an elongate piece of pile 707*a* and a mating elongate piece of hook 707*b*. The pile 707*a* and the hook 707*b* are each fastened at one end to the pad, at opposite sides of the pad 701, and extend toward a middle portion of the pad 701. The opposite, unfastened ends of the pile 707*a* and the hook 707*b* overlap and mate to secure the strap engaging member 707 in a closed position. The strap engaging member 707 is in an open position when the pile 707*a* and the hook 707*b* are not mating to engage one another. Strap engaging member 707 is shown in the open position. A channel 711 is defined proximate the pad 701 between the fastened ends of the pile 707*a* and the hook 707*b*. When the strap engaging member 707 is in a closed position, the channel 711 is further defined between the pad 701 and the strap engaging member 707.

The right shoulder pad 702 includes a strap engaging member 708, which is preferably an elongate piece of pile 708*a* and a mating elongate piece of hook 708*b*. The pile 708*a* and the hook 708*b* are each fastened at one end to the pad, at opposite sides of the pad 702, and extend toward a middle portion of the pad 702. The opposite, unfastened ends of the pile 708*a* and the hook 708*b* overlap and mate to secure the strap engaging member 708 in a closed position. The strap engaging member 708 is in an open position when the pile 708*a* and the hook 708*b* are not mating to engage one another. Strap engaging member 708 is shown in the closed position. A channel 712 is defined proximate the pad 702 between the fastened ends of the pile 708*a* and the hook 708*b*. When the strap engaging member 708 is in a closed position, the channel 712 is further defined between the pad 702 and the strap engaging member 708.

The left waist pad 703 includes a strap engaging member 709, which is preferably an elongate piece of pile 709*a* and a mating elongate piece of hook 709*b*. The pile 709*a* and the hook 709*b* are each fastened at one end to the pad, at opposite sides of the pad 703, and extend toward a middle portion of the pad 703. The opposite, unfastened ends of the pile 709*a* and the hook 709*b* overlap and mate to secure the strap engaging member 709 in a closed position. The strap engaging member 709 is in an open position when the pile 709*a* and the hook 709*b* are not mating to engage one another. A channel 713 is defined proximate the pad 703 between the fastened ends of the pile 709*a* and the hook 709*b*. When the strap engaging member 709 is in a closed position, the channel 713 is further defined between the pad 703 and the strap engaging member 709.

The right waist pad 704 includes a strap engaging member 710, which is preferably an elongate piece of pile 710*a* and a mating elongate piece of hook 710*b*. The pile 710*a* and the hook 710*b* are each fastened at one end to the pad, at opposite sides of the pad 704, and extend toward a middle portion of the pad 704. The opposite, unfastened ends of the pile 710*a* and the hook 710*b* overlap and mate to secure the strap engaging member 710 in a closed position. The strap engaging member 710 is in an open position when the pile 710*a* and the hook 710*b* are not mating to engage one another. A channel 714 is defined proximate the pad 704 between the fastened ends of the pile 710*a* and the hook 710*b*. When the strap engaging member 710 is in a closed position, the channel 714 is further defined between the pad 704 and the strap engaging member 710.

In operation, the strap engaging members 707, 708, 709, and 710 are each placed in the open position thereby providing access to the channels 711, 712, 713, and 714, respectively. The safety harness is placed on top of the padding 700. The back pad and D-ring assembly 728 is placed on top of the back pad 705, the left shoulder strap 725*a* is placed within the channel 711 on top of the pad 701, the right shoulder strap 726*a* is placed within the channel 712 on top of the pad 702, the left waist strap 726*b* is placed within the channel 713 on top of the pad 703, and the right waist strap 725*b* is placed within the channel 714 on top of the pad 704. The strap engaging members 707, 708, 709, and 710 are then placed in the closed position thereby securing each of the respective straps within the respective channels. The straps are slidably engaged within the channels, and the padding 700 does not interfere with the operation of the back pad and D-ring assembly 728.

It is understood that any of these features may be interchanged among the different preferred embodiments to create variations thereof and such variations are within the scope of the present invention. The above specification, examples and data provide a complete description of the manufacture and use of the composition of the invention. Since many embodiments of the invention can be made without departing from the spirit and scope of the invention, the invention resides in the claims hereinafter appended.

We claim:

1. A safety harness, comprising:

a) a first strap and a second strap operatively connected at a juncture;

b) a D-ring operatively connected to said straps proximate said juncture; and c) a removable padding having a releasable attachment member configured and arranged to releasably operatively connect said padding to said straps proximate said juncture, said releasable attachment member having a strap receiving position for receiving said straps and a stap securing position for securing said padding about said straps, said padding accommodating said D-ring without interfering with operation of said D-ring, said straps and said D-ring being movable and adjustable independently of said padding, said padding being retrofittable.

2. The safety harness of claim 1, further comprising a hip strap, said removable padding being configured and arranged to operatively connect to said hip strap.

3. The safety harness of claim 1, further comprising a panel operatively connected to said padding proximate each of said straps, said panel forming an elongated channel proximate each of said straps in which each of said straps is slidably secured between said panel and said padding, said panel releasably securing each of said straps within each of said elonaated channels.

4. The safety harness of claim 3, further comprising a material operatively connected to said padding within each said channel, said material providing friction against each of said straps thereby assisting in keeping said padding in place along each of said straps.

5. The safety harness of claim 3, further comprising a hook and loop fastener operatively connected to said panel, said hook and loop fastener releasably securing said panel to said padding, said straps being slidably and releasably secured within said channel.

6. The safety harness of claim 3, further comprising a zipper operatively connected to said panel, said zipper releasably securing said panel to said padding thereby slidably and releasably securing said straps within said channel.

7. The safety harness of claim 6, further comprising a stop operatively connected to said padding proximate said zipper, said stop assisting in preventing said zipper from becoming unfastened.

8. The safety harness of claim 1, further comprising a first panel and a second panel operatively connected to said padding proximate each of said straps, said first panel being releasably securable to said second panel, said panels forming a channel proximate each of said straps in which each of said straps is slidably secured between said panels and said padding, said panels releasably securing each of said straps within each said channel.

9. The safety harness of claim 8, wherein said first panel is operatively connected to a first side of said padding and said second panel is operatively connected to a second side of said padding, said panels being releasably securable proximate a middle portion of said padding.

10. The safety harness of claim 1, wherein said padding includes foam pads.

11. The safety harness of claim 10, further comprising air channels between said foam pads, said air channels allowing air to circulate between said foam pads.

12. The safety harness of claim 1, wherein said padding includes a 3-D fabric.

13. A safety harness, comprising:

a) a first strap and a second strap operatively connected at a juncture with a connecting member, said first strap and said second strap cooperating to form four strap segments extending from said juncture and said connecting member; and b) a removable padding configured and ranged to operatively connect to said first strap and said second strap proximate said juncture and said connecting member, said padding including four pad segments proximate each of said four strap segments, said four pad segments extending outward from a back pad proximate said juncture and said connecting member, said four pad segments each including a channel in which each respective strap segment is slidably and releasably secured to said padding, said four pad segments each having a strap receiving position for receiving said straps and a strap securing position for securing said padding about said straps, said padding being retrofittable.

14. The safety harness of claim 13, further comprising a hip strap, said removable padding including a fifth pad segment configured and arranged to operatively connect to said hip strap, said fifth pad segment including a channel in which said hip strap is slidably secured to said padding.

15. The safety harness of claim 13, further comprising a panel operatively connected to each of said four pad segments, said panel forming said channel in which each respective strap segment is slidably secured between said panel and said padding, said panel releasably securing each respective strap segment within said channel.

16. The safety harness of claim 15, further comprising a zipper operatively connected to each said panel, said zipper releasably securing said panel thereby slidably and releasably securing each said four strap segments within each said respective channel.

17. The safety harness of claim 15, further comprising a material operatively connected to said padding within said channel, said material providing friction against said straps thereby assisting in keeping said padding in place along said straps.

18. The safety harness of claim 13, further comprising a first panel and a second panel operatively connected to each of said four pad segments, said first panel being releasably securable to said second panel, said panels forming a channel in which each respective strap segment is slidably secured between said panels and said padding, said panels releasably seeming each respective strap within said channel.

19. The safety harness of claim 18, wherein said first panel is operatively connected to a first side of said padding and said second panel is operatively connected to a second side of said padding, said panels being releasably securable proximate a middle portion of said padding.

20. A retrofittable, removable padding for use with a safety harness donned by a worker, the safety harness including a first strap and a second strap operatively connected at a juncture, the safety harness including a D-ring operatively connected to the straps proximate the juncture, comprising:

a) a padding configured and arranged to operatively connect to the straps of the safety harness proximate the juncture, the padding accommodating the D-ring without interfering with operation of the D-ring, the straps and the D-ring being movable and adjustable independently of the padding, the padding being positioned between the worker and the straps of the safety harness; and b) a panel operatively connected to said padding proximate each of the straps, said panel forming a channel proximate each of the straps in which each of the straps is slidably secured between said panel and said padding, said panel having an open position and a closed position, said open position providing access to said channel, said closed position releasably securing each of the straps within each said channel between said panel and said padding, wherein each of the straps is removable from said padding when each respective said panel is in said open position.

21. The padding of claim 20, further comprising a zipper operatively connected to said panel, said zipper releasably securing said panel to said padding thereby slidably and releasably securing the straps within said channel.

22. A method of retrofitting a removable padding onto a safety harness donned by a worker, comprising:

a) providing a safety harness including a first strap and a second strap operatively connected at a juncture, the safety harness including a D-ring operatively connected to the straps proximate the juncture;

b) providing a removable padding configured and arranged to operatively connect to the straps of the safety harness proximate the juncture; and c) connecting the padding to the straps of the safety harness, the padding accommodating the D-ring without interfering with operation of the D-ring, the straps and the D-ring being movable and adjustable independently of the padding, the padding being connected to the straps of the safety harness by placing the straps of the safety harness within channels of the padding and securing the straps of the safety harness within the channels of the padding, the padding having an open position and a closed position, said open position providing access to said channels, said closed position releasably securing the straps within said channels of said padding, wherein said open position allows the straps to be removed from said padding.

23. The method of claim 22, wherein the straps of the safety harness are secured within the channels of the padding by operatively connecting a panel to the padding, the straps being slidably secured between the panel and the padding.

24. The method of claim 22, wherein the straps of the safety harness are secured within the channels of the padding by overlapping and securing panels together over the straps, the straps being slidably secured between the panel and the padding.

25. The method of claim 22, further comprising donning the safety harness, wherein the padding is between the worker and the straps of the safety harness.

26. The method of claim 25, further comprising:

a) removing the safety harness; and b) removing the padding from the safety harness.

27. A safety harness, comprising:

a) a first strap and a second strap operatively connected at a juncture;

b) a D-ring operatively connected to said straps proximate said juncture; and c) a removable padding having means for releasably connecting said removable padding to said straps proximate said juncture when said straps are intact, said removable padding accommodating said D-ring without interfering with operation of said D-ring, said straps and said D-ring being movable and adjustable independently of said removable padding, said removable padding being retrofittable.

28. The safety harness of claim 27, wherein said means for releasably said removable padding to said straps is a releasable attachment member having a swap receiving position for receiving said straps and a strap engaging position for engaging said straps.

29. A safety harness, comprising:

a) a first strap and a second strap configured and arranged to form an assembled safety harness;

b) a D-ring;

c) a connecting member operatively connecting said D-ring to said straps proximate a juncture of said straps; and d) a removable retrofittable padding having a releasable attachment member configured and arranged to releasably operatively connect said padding to said straps proximate said juncture when said safety harness is assembled, said padding accommodating said D-ring and said connecting member without interfering with operation of said D-ring, said straps, said connecting member, and said D-ring being movable and adjustable independently of said padding.

30. The safety harness of claim 29, wherein said releasable attachment member has a strap receiving position for receiving said straps and a strap engaging position for engaging said straps.

* * * * *

UNITED STATES PATENT AND TRADEMARK OFFICE

CERTIFICATE OF CORRECTION

PATENT NO. : 6,971,476 B2
DATED : December 6, 2005
INVENTOR(S) : Wolner et al.

It is certified that error appears in the above-identified patent and that said Letters Patent is hereby corrected as shown below:

Column 12,
Line 23, delete “elonaated” and insert -- elongated --.

Column 13,
Line 4, delete “ranged” and insert -- arranged --.

Signed and Sealed this

Fourteenth Day of March, 2006

JON W. DUDAS
*Director of the United States Patent and Trademark Office*

US006971476C1

(12) EX PARTE REEXAMINATION CERTIFICATE (6962nd)

United States Patent

Wolner et al.

(10) Number: US 6,971,476 C1

(45) Certificate Issued: Jul. 28, 2009

(54) SAFETY HARNESS

(75) Inventors: J. Thomas Wolner, Red Wing, MN (US); Scott C. Casebolt, St. Paul Park, MN (US); Luke A. Pezzimenti, San Francisco, CA (US)

(73) Assignee: D B Industries, Inc., Red Wing, MN (US)

Reexamination Request:
No. 90/008,045, Jun. 2, 2006

Reexamination Certificate for:

| | |
|---|---|
| Patent No.: | **6,971,476** |
| Issued: | **Dec. 6, 2005** |
| Appl. No.: | **10/819,035** |
| Filed: | **Apr. 6, 2004** |

Certificate of Correction issued Mar. 14, 2006.

Related U.S. Application Data

(60) Provisional application No. 60/500,597, filed on Sep. 5, 2003.

(51) Int. Cl.
*A47L 3/04* (2006.01)
*A62B 35/00* (2006.01)

(52) U.S. Cl. ..... 182/3; 119/770; 182/6

(58) Field of Classification Search ..... 297/482, 297/484

See application file for complete search history.

(56) References Cited

U.S. PATENT DOCUMENTS

| | | | | | |
|---|---|---|---|---|---|
| 3,957,282 | A | * | 5/1976 | Finnigan | 297/482 |
| 4,619,468 | A | * | 10/1986 | Spill | 297/482 |
| 4,795,190 | A | * | 1/1989 | Weightman et al. | 297/482 |
| 5,108,152 | A | * | 4/1992 | Reilly et al. | 297/482 |
| 6,446,273 | B1 | * | 9/2002 | Gillen et al. | 2/455 |

OTHER PUBLICATIONS http://www.technacurv.com, "Take the TechnaCurv Challenge", Mine Safety Appliances Co. (MSA), dated Aug. 28, 2003, 4 pages.*

Order dismissing the copending litigation in the United States District Court, District of Minnesota, *D B Industries, Inc. d/b/a DBI/SALA* v. *Alexander Andrew, Inc. and Custom Leathercraft Mfg. Co., Inc. d/b/a FallTech,* Civil Action No. 05–CV–2806 (JMR/FLN).

MSA Fall Protection Catalog [vol. 3–2001/2002], replaceable shoulder accessory pad, part No. 10028444, pp. 1, 17 and 23.

Rose Manufacturing Company, replaceable shoulder accessory pad, part No. 10028444, date unknown, front view of the replaceable shoulder pad with a safety harness connected thereto.

Rose Manufacturing Company, replaceable shoulder accessory pad, part No. 10028444, date unknown, front view of the replaceable shoulder pad with the lower left hook and loop fastener in an open position.

Rose Manufacturing Company, replaceable shoulder accessory pad, part No. 10028444, date unknown, front view of the lower left hook and loop fastener in an open position.

Rose Manufacturing Company, replaceable shoulder accessory pad, part No. 10028444, date unknown, side view of the upper right portion of the replaceable shoulder pad.

Rose Manufacturing Company, replaceable shoulder accessory pad, part No. 10028444, date unknown, rear view of the replaceable shoulder pad.

Rose Manufacturing Company, replaceable shoulder accessory pad, part No. 10028444, date unknown, cross–section view of the replaceable shoulder pad.

* cited by examiner

*Primary Examiner*—Peter C. English

(57) ABSTRACT

A preferred embodiment safety harness includes two straps that are operatively connected at a juncture and a D-ring proximate the juncture. A retrofittable, removable back panel padding is configured and arranged to accommodate the straps and D-ring to aid in the comfort in donning the safety harness.

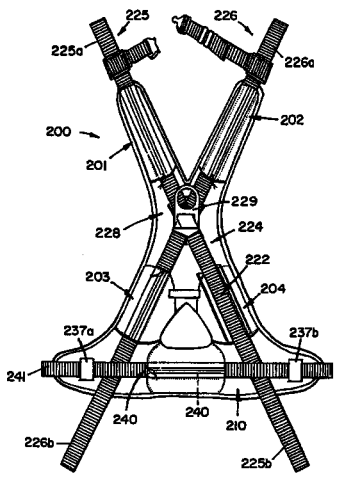

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 8–10, 13, 15 and 18–30 are cancelled.

Claims 2–7, 11, 12, 14, 16 and 17 are determined to be patentable as amended.

New claims 31–69 are added and determined to be patentable.

2. [The] *A* safety harness[of claim 1][further], comprising*:*

*a*) *a first strap and a second strap operatively connected at a juncture, said first and second straps extending above and below said juncture;*

*b*) *a D-ring operatively connected to said straps proximate said juncture;*

*c*) *a removable padding having a releasable attachment member configured and arranged to releasably operatively connect said padding to said straps proximate said juncture, said releasable attachment member having a strap receiving position for receiving said straps and a strap securing position for securing said padding about said straps, said padding accommodating said D-ring without interfering with operation of said D-ring, said straps and said D-ring being movable and adjustable independently of said padding, said padding being retrofittable; and*

*d*) a hip strap *operatively connected to said first and second straps below said juncture,* said removable padding being *further* configured and arranged to operatively connect to said hip strap.

3. The safety harness of claim [1] *2*, further comprising a panel operatively connected to said padding proximate each of said straps, said [panel] *panels* forming an elongated channel proximate each of said straps in which each of said straps is slidably secured between said [panel] *panels* and said padding, said [panel] *panels* releasably securing [each of] said straps within [each of] said elongated channels.

4. The safety harness of claim [3] *2*, further comprising *a panel operatively connected to said padding proximate each of said straps, said panels forming channels in which said straps are slidably secured between said panels and said padding, said panels releasably securing said straps within said channels, and* a material operatively connected to said padding within each said channel, said material providing friction against each of said straps thereby assisting in keeping said padding in place along each of said straps.

5. The safety harness of claim 3, further comprising a hook and loop fastener operatively connected to *each of* said [panel] *panels*, said hook and loop [fastener] *fasteners* releasably securing said [panel] *panels* to said padding, said straps being slidably and releasably secured with said [channel] *channels*.

6. The safety harness of claim 3, further comprising a zipper operatively connected to *each of* said [panel] *panels*, said [zipper] *zippers* releasably securing said [panel] *panels* to said padding thereby slidably and releasably securing said straps within said [channel] *channels*.

7. The safety harness of claim 6, further comprising a stop operatively connected to said padding proximate *each of* said [zipper] *zippers*, said [stop] *stops* assisting in preventing said [zipper] *zippers* from becoming unfastened.

11. The safety harness of claim [10] *2*[further comprising], *wherein said padding includes foam pads and* air channels between said foam pads, said air channels allowing air to circulate between said foam pads.

12. The safety harness of claim [1] *2*, wherein said padding includes a 3-D fabric.

14. [The] *A* safety harness[of claim 13][further], comprising*:*

*a*) *a first strap and a second strap operatively connected at a juncture with a connecting member, said first strap and said second strap cooperating to form four strap segments extending from said juncture and said connecting member;*

*b*) *a removable padding configured and arranged to operatively connect to said first strap and said second strap proximate said juncture and said connecting member, said padding including four pad segments proximate each of said four strap segments, said four pad segments extending outward from a back pad proximate said juncture and said connecting member, said four pad segments each including a channel in which each respective strap segment is slidably and releasably secured to said padding, said four pad segments each having a strap receiving position for receiving said straps and a strap securing position for securing said padding about said straps, said padding being retrofittable; and*

*c*) a hip strap, said removable padding including a fifth pad segment configured and arranged to operatively connect to said hip strap, said fifth pad segment including a channel in which said hip strap is slidably secured to said padding.

16. The safety harness of claim [15] *17*, further comprising a zipper operatively connected to each said panel, said zipper releasably securing said panel thereby slidably and releasably securing each said four strap segments within each said respective channel.

17. [The] *A* safety harness[of claim 15][further], comprising*:*

*a*) *a first strap and a second strap operatively connected at a juncture with a connecting member, said first strap and said second strap cooperating to form four strap segments extending from said juncture and said connecting member;*

*b*) *a removable padding configured and arranged to operatively connect to said first strap and said second strap proximate said juncture and said connecting member, said padding including four pad segments proximate each of said four strap segments, said four pad segments extending outward from a back pad proximate said juncture and said connecting member, said four pad segments each including a channel in which each respective strap segment is slidably and releasably secured to said padding, said four pad segments each having a strap receiving position for receiving said straps and a strap securing position for securing said padding about said straps, said padding being retrofittable;*

*c) a panel operatively connected to each of said four pad segments, said panels forming said channels in which said strap segments are slidably secured between said panels and said padding, said panels releasably securing said strap segments within said channels; and*

*d)* a *rubber* material operatively connected to said padding within said [channel] *channels*, said *rubber* material providing friction against said straps thereby assisting in keeping said padding in place along said straps.

*31. A safety harness, comprising:*

*a) a first strap and a second strap operatively connected at a juncture and cooperating to form four strap segments extending from the juncture;*

*b) a D-ring;*

*c) a connecting member operatively connecting the D-ring to the straps proximate the juncture, the four strap segments extending from the connecting member; and*

*d) a removable retrofittable padding including four pad segments, the four pad segments corresponding with the four strap segments, the four pad segments extending outward from a back pad proximate the juncture and the connecting member, each pad segment having a panel and a releasable attachment member proximate a respective one of the strap segments, the panels being operatively connected to the padding and forming channels proximate each of the strap segments in which each of the straps is slidably secured between a respective one of the panels and the padding, the padding accommodating the D-ring without interfering with operation of the D-ring, the straps and the D-ring being movable and adjustable independently of the padding, the panels releasably securing the straps within the channels thereby connecting the padding to the straps proximate the juncture and the connecting member, the panels each having a strap receiving position for receiving the straps and a strap securing position for securing the padding about the straps, the releasable attachment members being operatively connected to the panels and releasably securing the panels in the strap securing position, wherein the padding includes a hydrophobic material and a hydrophilic material, the hydrophobic material being an inner layer and the hydrophilic material being an outer layer relative to the inner layer to wick moisture away from the inner layer.*

*32. The safety harness of claim 31, wherein each of the channels is elongated and has a width of approximately 2 inches and a length longer than the width.*

*33. The safety harness of claim 31, wherein the padding includes 3-D fabric.*

*34. The safety harness of claim 31, wherein the padding includes air channels.*

*35. The safety harness of claim 31, further comprising a safety device holder operatively connected to the padding.*

*36. The safety harness of claim 31, wherein the four pad segments include a first pad segment and a second pad segment of the padding and further comprising a connecting strap interconnecting the first pad segment and the second pad segment, wherein the connecting strap is made of an elastic material.*

*37. The safety harness of claim 31, wherein the panels are first panels and further comprising a second panel operatively connected to the padding proximate each of the straps, the releasable attachment members releasably securing the first panels to the second panels, the first panels and the second panels forming the channels proximate each of the straps in which each of the straps is slidably secured between the first panels, the second panels, and the padding, the first panels and the second panels releasably securing each of the straps within the channels.*

*38. The safety harness of claim 33, wherein each of the first panels is operatively connected to a first side of the padding proximate each of the respective strap segments and each of the second panels is operatively connected to a second side of the padding proximate each of the respective strap segments, the first panels and the second panels being releasably securable proximate a middle portion of the padding proximate each of the respective strap segments.*

*39. The safety harness of claim 31, wherein the releasable attachment members are a fastener selected from the group consisting of hook and loop fasteners, zippers, snaps, laces, and buckles.*

*40. A safety harness, comprising:*

*a) a first strap and a second strap operatively connected at a juncture and cooperating to form four strap segments extending from the juncture;*

*b) a D-ring:*

*c) a connecting member operatively connecting the D-ring to the straps proximate the juncture, the four strap segments extending from the connecting member, each of the straps having a first strap segment and a second strap segment proximate opposing sides of the connecting member;*

*d) a removable retrofittable padding including four pad segments, the four pad segments corresponding with the four strap segments, the four pad segments extending outward from a back pad proximate the juncture and the connecting member, each pad segment having a panel and a releasable attachment member proximate a respective one of the strap segments, the panels being operatively connected to the padding and forming channels proximate each of the strap segments in which each of the straps is slidably secured between a respective one of the panels and the padding, the padding accommodating the D-ring without interfering with operation of the D-ring, the straps and the D-ring being movable and adjustable independently of the padding, the panels releasably securing the straps within the channels thereby connecting the padding to the straps proximate the juncture and the connecting member, the panels each having a strap receiving position for receiving the straps and a strap securing position for securing the padding about the straps, the releasable attachment members being operatively connected to the panels and releasably securing the panels in the strap securing position; and*

*e) a rubber material operatively connected to the padding within each of the channels, the material providing friction against each of the straps thereby assisting in keeping the padding in place along each of the straps.*

*41. The safety harness of claim 40, wherein each of the channels is elongated and has a width of approximately 2 inches and a length longer than the width.*

*42. The safety harness of claim 40, wherein the padding includes a 3-D fabric.*

*43. The safety harness of claim 40, wherein the padding includes air channels.*

*44. A safety harness, comprising:*

*a) a first strap and a second strap operatively connected at a juncture and cooperating to form four strap segments extending from the juncture;*

*b) a D-ring:*

*c) a connecting member operatively connecting the D-ring to the straps proximate the juncture, the four strap segments extending from the connecting member, each of the straps having a first strap segment and a second strap segment proximate opposing sides of the connecting member;*

*d) a removable retrofittable padding including four pad segments, the four pad segments corresponding with the four strap segments, the four pad segments extending outward from a back pad proximate the juncture and the connecting member, each pad segment having a panel and a releasable attachment member proximate a respective one of the strap segments, the panels being operatively connected to the padding and forming channels proximate each of the strap segments in which each of the straps is slidably secured between a respective one of the panels and the padding, the padding accommodating the D-ring without interfering with operation of the D-ring, the straps and the D-ring being movable and adjustable independently of the padding, the panels releasably securing the straps within the channels thereby connecting the padding to the straps proximate the juncture and the connecting member, the panels each having a strap receiving position for receiving the straps and a strap securing position for securing the padding about the straps, the releasable attachment members being operatively connected to the panels and releasably securing the panels in the strap securing position; and*

*e) wherein the four segments include a first pad segment and a second pad segment of the padding extending downward from proximate the juncture and further comprising a connecting strap interconnecting the first pad segment and the second pad segment, wherein the connecting strap is made of an elastic material.*

*45. The safety harness of claim 44, wherein each of the channels is elongated and has a width of approximately 2 inches and a length longer than the width.*

*46. A retrofittable removable padding assembly for use with a safety harness donned by a worker, the safety harness including a first strap and a second strap operatively connected at a juncture and a D-ring operatively connected to the straps proximate the juncture, each of the straps having a first strap segment and a second strap segment proximate opposing sides of the D-ring, comprising:*

*a) a padding configured and arranged to operatively connect to the strap segments of the safety harness proximate the juncture, the padding being positioned between the worker and the straps of the safety harness, the padding accommodating the D-ring without interfering with operation of the D-ring, the straps and the D-ring being movable and adjustable independently of the padding; and*

*b) a panel operatively connected to the padding proximate each of the strap segments above and below the juncture, the panels forming a channel proximate each of the strap segments in which each of the straps is slidably secured between the panels and the padding, each of the panels having an open position and a closed position, the open position providing access to the channels, the closed position releasably securing each of the strap segments within the respective channels between the panels and the padding, wherein each of the straps is removable from the padding when each of the respective panels is in the open position, wherein the padding includes a hydrophobic material and a hydrophilic material, the hydrophobic material being an inner layer and the hydrophilic material being an outer layer relative to the inner layer to wick moisture away from the inner layer.*

*47. The retrofittable removable padding assembly of claim 46, wherein each of the channels is elongated and has a width of approximately 2 inches and a length longer than the width.*

*48. A retrofittable removable padding assembly for use with a safety harness donned by a worker, the safety harness including a first strap and a second strap operatively connected at a juncture and a D-ring operatively connected to the straps proximate the juncture, each of the straps having a first strap segment and a second strap segment proximate opposing sides of the D-ring, comprising:*

*a) a padding configured and arranged to operatively connect to the strap segments of the safety harness proximate the juncture, the padding being positioned between the worker and the straps of the safety harness, the padding accommodating the D-ring without interfering with operation of the D-ring, the straps and the D-ring being movable and adjustable independently of the padding;*

*b) a panel operatively connected to the padding proximate each of the strap segments above and below the juncture, the panels forming a channel proximate each of the strap segments in which each of the straps is slidably secured between the panels and the padding, each of the panels having an open position and a closed position, the open position providing access to the channels, the closed position releasably securing each of the strap segments within the respective channels between the panels and the padding, wherein each of the straps is removable from the padding when each of the respective panels is in the open position; and*

*c) a rubber material operatively connected to the padding within each of the channels, the material providing friction against each of the straps thereby assisting in keeping the padding in place along each of the straps.*

*49. The retrofittable removable padding assembly of claim 48, further comprising a safety device holder operatively connected to the padding.*

*50. The retrofittable removable padding assembly of claim 48, further comprising a first pad segment and a second pad segment of the padding and a connecting strap interconnecting the first pad segment and the second pad segment, wherein the connecting strap is made of an elastic material.*

*51. The retrofittable removable padding assembly of claim 48, wherein each of the channels is elongated and has a width of approximately 2 inches and a length longer than the width.*

*52. A retrofittable removable padding assembly for use with a safety harness donned by a worker, the safety harness including a first strap and a second strap operatively connected at a juncture and a D-ring operatively connected to the straps proximate the juncture, each of the straps having a first strap segment and a second strap segment proximate opposing sides of the D-ring, comprising:*

*a) a padding configured and arranged to operatively connect to the strap segments of the safety harness proximate the juncture, the padding being positioned between the worker and the straps of the safety harness, the padding accommodating the D-ring without interfering with operation of the D-ring, the straps and the D-ring being movable and adjustable independently of the padding;* b) a panel operatively connected to the padding proximate each of the strap segments above and below the juncture, the panels forming a channel proximate each of the strap segments in which each of the straps is slidably secured between the panels and the padding, each of the panels having an open position and a closed position, the open position providing access to the channels, the closed position releasably securing each of the strap segments within the respective channels between the panels and the padding, wherein each of the straps is removable from the padding when each of the respective panels is in the open position; and c) a first pad segment and a second pad segment of the padding extending downward from proximate the juncture and a connecting strap interconnecting the first pad segment and the second pad segment, wherein the connecting strap is made of an elastic material.

53. The retrofittable removable padding assembly of claim 52, wherein the panels are first panels and further comprising a second panel operatively connected to the padding proximate each of the strap segments, a releasable attachment member releasably securing each of the first panels to the respective second panels, the first panels and the second panels forming the channels proximate the straps in which the straps are slidably secured between the first panels, the second panels, and the padding, the first panels and the second panels releasably securing the straps within the channels.

54. The retrofittable removable padding assembly of claim 53, wherein each of the first panels is operatively connected to a first side of the padding proximate each of the strap segments and each of the second panels is operatively connected to a second side of the padding proximate each of the strap segments, the first panels and the second panels being releasably securable proximate a middle portion of the padding proximate each of the strap segments.

55. The retrofittable removable padding assembly of claim 53, wherein the releasable attachment members are a fastener selected from the group consisting of hook and loop fasteners, zippers, snaps, laces, and buckles.

56. The retrofittable removable padding assembly of claim 52, wherein the panels form an elongated channel proximate each of the straps.

57. The padding of claim 56, wherein each of the elongated channels has a width of approximately 2 inches and a length longer than the width.

58. The retrofittable removable padding assembly of claim 52, wherein the padding includes air channels.

59. A retrofittable removable padding assembly for use with a safety harness donned by a worker, the safety harness including a first strap and a second strap operatively connected at a juncture and a D-ring operatively connected to the straps proximate the juncture, each of the straps having a first strap segment and a second strap segment proximate opposing sides of the D-ring, comprising:

a) a padding including a 3-D fabric and configured and arranged to operatively connect to the strap segments of the safety harness proximate the juncture, the padding being positioned between the worker and the strap segments of the safety harness, the padding accommodating the D-ring without interfering with operation of the D-ring, the straps and the D-ring being movable and adjustable independently of the padding, wherein the padding includes a hydrophobic material and a hydrophilic material, the hydrophobic material being an inner layer and the hydrophilic material being an outer layer to wick moisture away from the inner layer;

b) a panel operatively connected to the padding proximate each of the strap segments, the panels forming channels proximate the strap segments in which each of the straps is slidably secured between the panels and the padding, each of the panels having an open position and a closed position, the open position providing access to the respective channel, the closed position releasably securing the respective strap segments within the respective channels between the panels and the padding, wherein each of the straps is removable from the padding when each respective panel is in the open position; and c) a material operatively connected to the padding within each of the channels, the material configured and arranged to provide friction against each of the strap segments thereby assisting in keeping the padding in place along each of the straps.

60. The retrofittable removable padding assembly of claim 59, further comprising a safety device holder operatively connected to the padding.

61. The retrofittable removable padding assembly of claim 59, further comprising a first pad segment and a second pad segment of the padding and a connecting strap interconnecting the first pad segment and the second pad segment, wherein the connecting strap is made of an elastic material.

62. A retrofittable removable padding assembly for use with a safety harness donned by a worker, the safety harness including a first strap and a second strap operatively connected at a juncture and a D-ring operatively connected to the straps proximate the juncture, each of the straps having a first strap segment and a second strap segment proximate opposing sides of the D-ring, comprising:

a) a padding including a 3-D fabric and configured and arranged to operatively connect to the strap segments of the safety harness proximate the juncture, the padding being positioned between the worker and the strap segments of the safety harness, the padding accommodating the D-ring without interfering with operation of the D-ring, the straps and the D-ring being movable and adjustable independently of the padding;

b) a panel operatively connected to the padding proximate each of the strap segments, the panels forming channels proximate the strap segments in which each of the straps is slidably secured between the panels and the padding, each of the panels having an open position and a closed position, the open position providing access to the respective channel, the closed position releasably securing the respective strap segments within the respective channels between the panels and the padding, wherein each of the straps is removable from the padding when each respective panel is in the open position;

c) a material operatively connected to the padding within each of the channels, the material configured and arranged to provide friction against each of the strap segments thereby assisting in keeping the padding in place along each of the straps; and d) a first pad segment and a second pad segment of the padding extending downward from proximate the juncture and a connecting strap interconnecting the first pad segment and the second pad segment, wherein the connecting strap is made of an elastic material.

63. The retrofittable removable padding assembly of claim 62, wherein the panels are first panels and further comprising a second panel operatively connected to the padding proximate each of the straps, a releasable attachment mem-

*ber releasably securing each of the first panels to the respective second panels, the first panels and the second panels forming the channels proximate the straps in which the straps are slidably secured between the first panels, the second panels, and the padding, the first panels and the second panels releasably securing the straps within channels.*

*64. The retrofittable removable padding assembly of claim 63, wherein the first panels are operatively connected to a first side of the padding proximate each of the strap segments and the second panels are operatively connected to a second side of the padding proximate each of the strap segments, the first panels and the second panels being releasably securable proximate a middle portion of the padding proximate each of the strap segments.*

*65. A retrofittable removable padding assembly for use with a safety harness donned by a worker, the safety harness including a first strap and a second strap operatively connected at a juncture and a D-ring operatively connected to the straps proximate the juncture, each of the straps having a first strap segment and a second strap segment proximate opposing sides of the D-ring, comprising:*

*a) a padding including a 3-D fabric and configured and arranged to operatively connect to the strap segments of the safety harness proximate the juncture, the padding being positioned between the worker and the strap segments of the safety harness, the padding accommodating the D-ring without interfering with operation of the D-ring, the straps and the D-ring being movable and adjustable independently of the padding;*

*b) a panel operatively connected to the padding proximate each of the strap segments, the panels forming channels proximate the strap segments in which each of the straps is slidably secured between the panels and the padding, each of the panels having an open position and a closed position, the open position providing access to the respective channel, the closed position releasably securing the respective strap segments within the respective channels between the panels and the padding, wherein each of the straps is removable from the padding when each respective panel is in the open position; and*

*c) a material operatively connected to the padding within each of the channels, the material configured and arranged to provide friction against each of the strap segments thereby assisting in keeping the padding in place along each of the straps, wherein the material is a rubber material.*

*66. The retrofittable removable padding assembly of claim 65, further comprising a releasable attachment member operatively connected to each of the panels to releasably secure the panels in the closed position, wherein the releasable attachment members are a fastener selected from the group consisting of hook and loop fasteners, zippers, snaps, laces, and buckles.*

*67. A retrofittable removable padding assembly for use with a safety harness donned by a worker, the safety harness including a first strap and a second strap operatively connected at a juncture and a D-ring operatively connected to the straps proximate the juncture, each of the straps having a first strap segment and a second strap segment proximate opposing sides of the D-ring, comprising:*

*a) a padding configured and arranged to operatively connect to the strap segments of the safety harness proximate the juncture, the padding being positioned between the worker and the strap segments of the safety harness, the padding accommodating the D-ring without interfering with operation of the D-ring, the straps and the D-ring being movable and adjustable independently of the padding;*

*b) a panel operatively connected to the padding proximate each of the strap segments, the panels forming channels proximate the strap segments in which each of the straps is slidably secured between the panels and the padding, each of the panels having an open position and a closed position, the open position providing access to the respective channel, the closed position releasably securing the respective strap segments within the respective channels between the panels and the padding, wherein each of the straps is removable from the padding when each respective panel is in the open position; and*

*c) a rubber material operatively connected to the padding within each of the channels, the rubber material configured and arranged to provide friction against each of the strap segments thereby assisting in keeping the padding in place along each of the straps.*

*68. A retrofittable removable padding assembly for use with a safety harness donned by a worker, the safety harness including a first strap and a second strap operatively connected at a juncture and a D-ring operatively connected to the straps proximate the juncture, each of the straps having a first strap segment and a second strap segment proximate opposing sides of the D-ring, comprising:*

*a) a padding configured and arranged to operatively connect to the strap segments of the safety harness proximate the juncture, the padding being positioned between the worker and the strap segments of the safety harness, the padding accommodating the D-ring without interfering with operation of the D-ring, the straps and the D-ring being movable and adjustable independently of the padding;*

*b) a panel operatively connected to the padding proximate each of the strap segments, the panels forming channels proximate each of the strap segments in which each of the straps is slidably secured between the panels and the padding, each of the panels having an open position and a closed position, the open position providing access to the respective channel, the closed position releasably securing the respective strap segments within the respective channels between the panels and the padding, wherein each of the straps is removable from the padding when each respective panel is in the open position; and*

*c) a first pad segment and a second pad segment of the padding extending downward from proximate the juncture and a connecting strap interconnecting the first pad segment and the second pad segment, wherein the connecting strap is made of an elastic material.*

*69. A retrofittable removable padding assembly for use with a safety harness donned by a worker, the safety harness including a first strap and a second strap operatively connected at a juncture and a D-ring operatively connected to the straps proximate the juncture, each of the straps having a first strap segment and a second strap segment proximate opposing sides of the D-ring, comprising:*

*a) a padding configured and arranged to operatively connect to the strap segments of the safety harness proximate the juncture, the padding being positioned between the worker and the strap segments of the safety harness, the padding accommodating the D-ring without interfering with operation of the D-ring, the straps and the D-ring being movable and adjustable independently of the padding, wherein the padding includes a*

*hydrophobic material and a hydrophilic material, the hydrophobic material being an inner layer and the hydrophilic material being an outer layer to wick moisture away from the inner layer; and*

*b) a panel operatively connected to the padding proximate each of the strap segments, the panels forming channels proximate the strap segments in which each of the straps is slidably secured between the panels and the padding, each of the panels having an open position and a closed position, the open position providing access to the respective channel, the closed position releasably securing the respective strap segments within the respective channels between the panels and the padding, wherein each of the straps is removable from the padding when each respective panel is in the open position.*

* * * * *